US006786153B2

(12) United States Patent
Burrow et al.

(10) Patent No.: US 6,786,153 B2
(45) Date of Patent: Sep. 7, 2004

(54) PRINTING ROLLS HAVING WEAR INDICATORS AND METHODS FOR DETERMINING WEAR OF PRINTING AND ANILOX ROLLS AND SLEEVES

(75) Inventors: William Burrow, Inman, SC (US); Gregory Haley, Moore, SC (US)

(73) Assignee: Interflex Laser Engravers, LLC, Spartanburg, SC (US)

( * ) Notice: Subject to any disclaimer, the term of this patent is extended or adjusted under 35 U.S.C. 154(b) by 0 days.

(21) Appl. No.: 10/247,528

(22) Filed: Sep. 19, 2002

(65) Prior Publication Data

US 2004/0055489 A1 Mar. 25, 2004

(51) Int. Cl.[7] ..... B41F 31/07

(52) U.S. Cl. ..... 101/352.13; 101/170; 101/153; 101/483; 116/208

(58) Field of Search ..... 101/153, 170, 101/352.11, 352.13; 492/9, 11; 116/203

(56) References Cited

U.S. PATENT DOCUMENTS

| | | | | |
|---|---|---|---|---|
| 2,706,509 A | * | 4/1955 | White | 152/209.21 |
| 4,566,938 A | * | 1/1986 | Jenkins et al. | 216/10 |
| 5,558,020 A | | 9/1996 | Marozzi et al. | |
| 5,800,856 A | * | 9/1998 | Hong Vuong | 427/9 |
| 6,240,639 B1 | | 6/2001 | Hycner | |
| 6,293,195 B1 | | 9/2001 | Allison, Jr. | |
| 6,431,066 B1 | * | 8/2002 | Perez et al. | 101/350.6 |
| 6,523,586 B1 | * | 2/2003 | Eromki et al. | 152/154.2 |

FOREIGN PATENT DOCUMENTS

| | | |
|---|---|---|
| DE | 3336374 A1 | 4/1985 |
| EP | 0748701 A2 | 12/1996 |
| EP | 1066991 A2 | 1/2001 |

OTHER PUBLICATIONS

Praxair Surface Technologies, entitled "Ceramic Anilox Roll Care and Maintenance", Praxair S.T. Technology Inc., USA.
Frank M.J. Van Der Berg, FlexoExchange, entitled "Laser Engraving of Anilox Rolls: The Next Paradigm Shift", http://www.flexoexchange.com/gorilla/tofcarticle.html, Flexo Magazine, Dec. 1997.
Steve Tucker, entitled "Troubleshooting Laser Engraved Anilox Roll Problems", http://www.harperimage.com/FlexoTech/troubleshoot_printing_problems.htm, Harper News 1999.
Steve Tucker, entitled "Anilox Specifications: What Characteristics are Important?", http://www.harperimage.com/anilox/specifications.htm, Flexo Magazine, Aug. 1997.

* cited by examiner

*Primary Examiner*—Andrew H. Hirshfeld
*Assistant Examiner*—Leo T. Hinze
(74) *Attorney, Agent, or Firm*—Dority & Manning, P.A.

(57) ABSTRACT

A printing device, system and method are disclosed for measuring and displaying the amount of wear experienced by printing rolls. A wear detection mechanism is employed in connection with rolls, such as anilox-type rolls that transfer ink to a substrate in forming a printed image. A wear detection mechanism is engraved, etched, or the like into the outer circumferential surface of the roll to provide an indication of the amount of wear experienced by the roll. Portions provided in series at predetermined depths may be correlated with a depletion scale indicia to display the wear condition of a particular roll in a printing system. A depletable wear strip comprising multiple engraved portions which correlate with values upon a depletion scale may be employed.

24 Claims, 4 Drawing Sheets

PRINTING ROLLS HAVING WEAR INDICATORS AND METHODS FOR DETERMINING WEAR OF PRINTING AND ANILOX ROLLS AND SLEEVES

BACKGROUND OF THE INVENTION

Modern printing rolls may be formed in a number of ways, including by overcoating a smooth metallic core with a metal layer, followed by applying an outer ceramic coating. The outer ceramic coating then may be engraved using a laser to form a desired cell pattern in the ceramic. Various printing rolls or sleeves exemplified by anilox rolls, engraved rolls, form rolls, meter rolls, knurled rolls, ink applicator rolls, sleeves, ink transfer rolls, and the like may utilize the present invention if they wear during use. Printing rolls and/or sleeves typically include a series of engraved cells or the like upon their outer surface. The cells are configured to receive and transfer colorants such as ink in the formation of an image or coloration on a substrate.

In the operation of flexographic printers, for example, ink from a reservoir is transferred to a roll, such as an anilox roll. The anilox roll then transfers the ink to a printing plate, which may be mounted to the surface of a print cylinder. The web or substrate is printed when the print cylinder and inked printing plate roll over the web, transferring the image to the web. This process may be repeated thousands of times.

The outer surface of printing rolls, such as an anilox rolls, may experience significant amounts of wear, which are the subject of this invention. As the outer surface wears, cells in the outer surface of the roll are worn away and their volumes are reduced. These cells, which sometimes form an inverted pyramid or a hexagon, supply a fixed quantity of ink that is passed to the web or substrate during printing, based on the volume of the cell.

As the roll wears, and the cells erode, a significant reduction in ink volume is transferred to the printing substrate by each cell. For example, a 20% reduction of depth in an inverted pyramid cell may lead to a 40–50% reduction in volume of ink transferred depending upon the screen count and cutting angle. This undesirably may result in a noticeable decrease in print density in the transferred image.

Printing personnel may compensate for such wear by adjusting the intensity of ink applied to the roll. In the past, as a roll is used, the amount of wear has been estimated, and the ink concentration applied to the roll was periodically adjusted to increase the intensity of the ink, thereby compensating for such wear. To determine the actual amount of wear, it has usually been required that the roll be removed from service, and examined with a magnifying apparatus, such as a microscope. The periodic compensation for roll wear to maintain a consistent image is a significant challenge in conducting such printing processes.

For example, it is often difficult to determine how much wear a particular roll has experienced. The degree of wear, however, is necessary information for ink adjustments. Furthermore, estimates of the ink concentration necessary to produce the desired image are not always accurate. Errors easily can be made in the amount of ink applied to the roll, sometimes resulting in an undesirable or inconsistent image or coloration applied to the substrate.

What is needed in the printing industry is an apparatus and method for accurately and quickly determining the amount of wear that has been experienced by a roll. An apparatus that provides to printing personnel updated or "real time" information regarding the amount of wear experienced by the outer surface of such rolls would be very desirable. Such an apparatus and method of use of same could enable more accurate and more convenient adjustment of the amount of colorant or ink applied, thereby improving the continuity of high quality, consistent printing. An apparatus or method that could supply wear data or information without requiring that the roll be dismounted and examined by magnification devices would be particularly useful.

Sometimes, the print machinery is out of alignment, resulting in uneven wear along the length of the roll, or a roll when provided is "out of round". It would also be important for printing personnel to be aware of such abnormalities which can lend to off quality production. Wear indicating apparatus and methods that could alert to uneven wear, out of round rolls and the like would be therefore quite useful.

SUMMARY OF THE INVENTION

In the present invention, a printing device for applying colorant to a substrate is provided. A roll having an outer circumferential surface with a plurality of transferring cells receives colorant from a reservoir to a substrate. A wear indicator mechanism is configured to detect wear and transfer the colorant of the outer circumferential surface of the roll. In some applications, the roll may be an anilox roll with a ceramic coating on its outer surface. In some applications, an outer sleeve is applied to the exterior surface.

In another embodiment of the invention, a system for determining the amount of wear that has been experienced by a roll or sleeve in a printing system is provided. In the system, a reservoir supplies colorant to the roll which is metered by a doctor blade, with respect to the plurality of transferring cells located on the outer surface of the roll. The transferring cells receive colorant from the reservoir and transfer the colorant to a substrate. One or more doctor blades wipe across the surface of the roll, metering colorant to the transferring cells. The doctor blades function as a dam or barrier for the colorant reservoir. The printing roll rotates while bearing against the doctor blade(s), and the portion of the outer circumferential surface on the roll that is engaged by a doctor blade defines a wear surface, and does wear during use.

A wear indicator mechanism or means provided on the outer circumferential surface of the roll measures the amount of wear experienced by the roll. In one embodiment, the wear indicator includes a plurality of indicator cells at various predetermined depths upon the outer circumferential surface of the roll. In other embodiments, a single indicator cell is employed. The indicator cells may be provided in alignment with a wear scale, which provides numerical or other indication of the amount of wear that has been experienced by the wear surface of a roll. However, other embodiments do not employ a scale or other indicia, but instead rely upon erasure of a textured surface to indicate the degree of wear upon a roll.

In yet another application of the invention, a method for detecting the amount of wear experienced by a printing roll is provided. The method includes providing a cylindrical roll having a wear-detection mechanism configured to detect depletion of the outer surface of the cylindrical roll. The roll is rotated, thereby transferring ink from a supply to a substrate. As the wear surface of the roll is depleted, the wear indicator mechanism makes it possible to observe the amount of roll wear.

BRIEF DESCRIPTION OF THE DRAWINGS

A full and enabling disclosure of this invention, including the preferred embodiment, is set forth in this specification. The following Figures are illustrative of embodiments of the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention.

Figure 1:
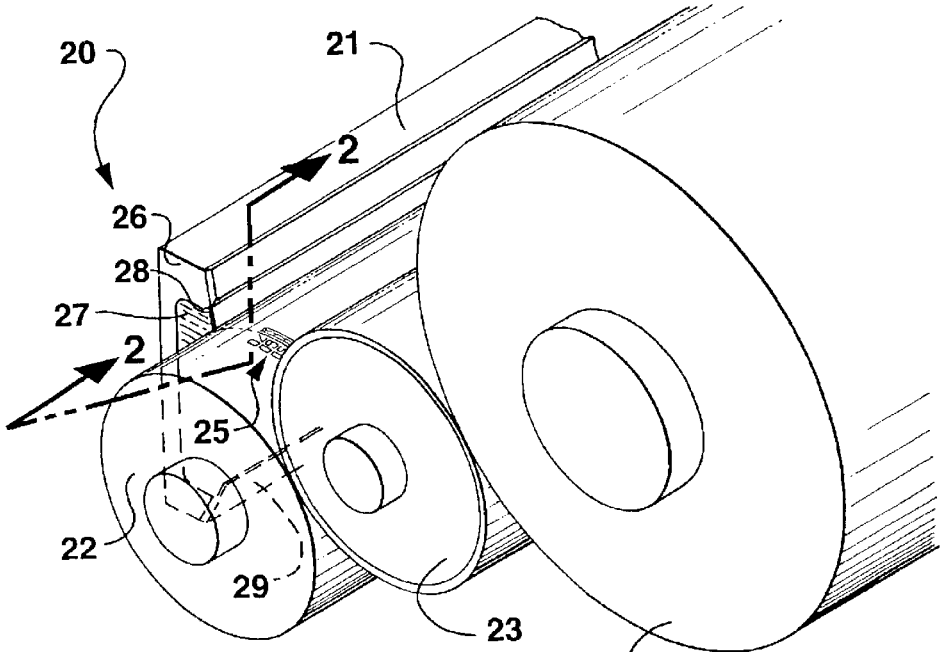
FIG. 1 is a perspective view of a printing system that includes a wear indicator according to the present invention.

Turning to FIG. 1, a printing system generally 20 is shown in which a colorant supply unit 21 supplies colorant to a roll 22. Colorant supply unit 21 transfers colorant which is held within a reservoir 27 of a body 26. A first doctor blade 28 and a second doctor blade 29 (shown in phantom in FIG. 1) form the limits of reservoir 27, and bear against the outer surface of the roll 22 to meter colorant into transferring cells of the roll (cells not shown). The portion of the roll subject to the respective first and second doctor blades 28–29 is shown as wear surface zone 39 in FIG. 3. FIG. 1 shows one embodiment of a wear indicator mechanism generally 25 which will be fully described herein. Once colorant has passed to roll 22, it is transferred to image carrier 23, and then to a substrate or flexible web (not shown) that rotates upon drum 24. Colorant within the reservoir 27 may be ink or any other substance that provides a color or visually perceptible image. Ink is typically used as a colorant in such apparatus.

Figure 2:
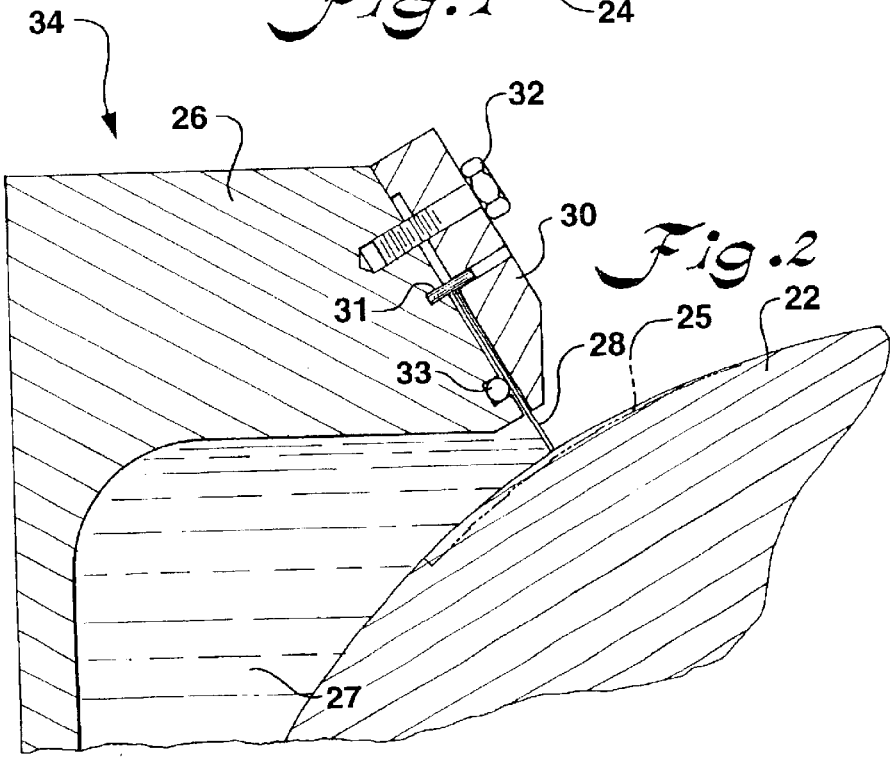
FIG. 2 shows a cross-sectional view of the printing system of FIG. 1 taken along line 2—2.

In FIG. 2, a cross sectional view along lines 2—2 of FIG. 1 is provided. A clamping bar 30 holds in place first doctor blade 28, which bears against roll 22. The wear indicator mechanism 25 is shown in phantom passing beneath the first doctor blade 28. Alignment pin 31 is shown at the upper portion of the first doctor blade 28, and a bolt 32 holds the clamping bar 30 in place against the body 26 of the inking unit 34, though any suitable arrangement for securing doctor blades 28–29 may be provided. An elastic seal 33 is provided between the first doctor blade 28 and the body 26 to seal reservoir 27 at that point. In other applications, an outer sleeve is employed. The use of "roll" herein shall be construed to also cover the use of transfer sleeves and the like.

Figure 3:
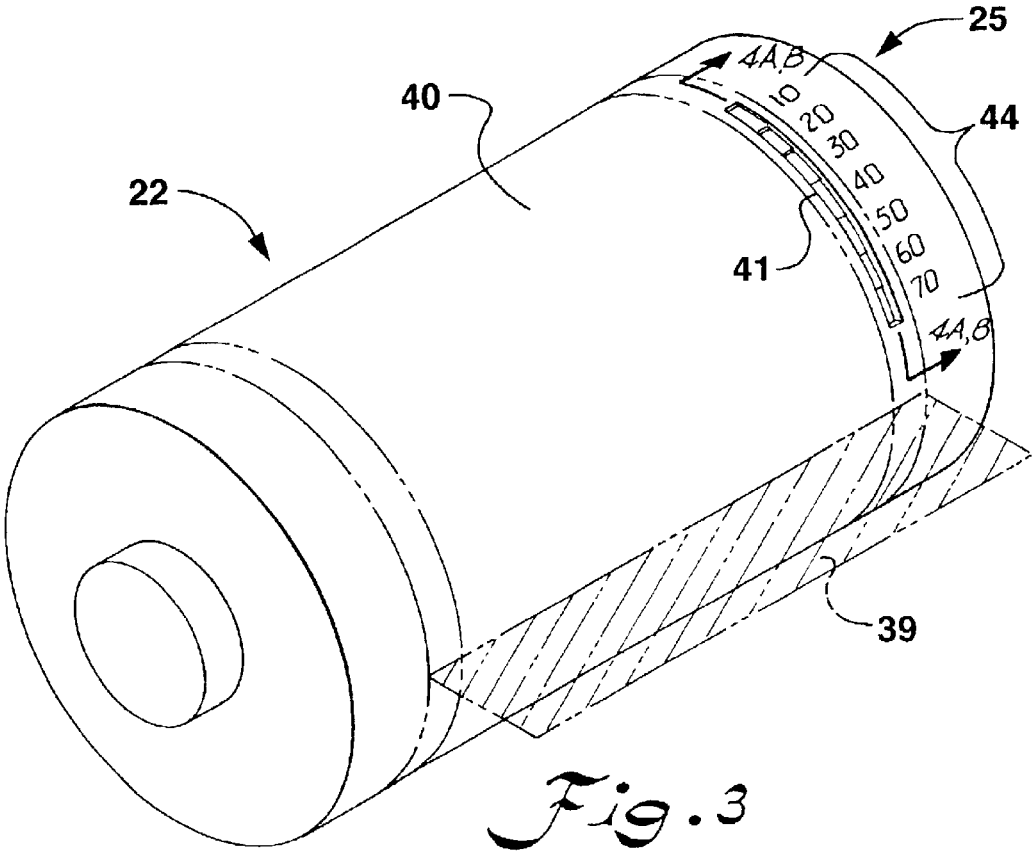
FIG. 3 depicts a perspective view of a print roll 22 according to the present invention, illustrating a preferred embodiment of a wear indicator mechanism.

FIG. 3 shows a perspective view of a roll 22 which has been removed from a printing system such as 20 for purposes of illustration, and which forms an embodiment of the invention. The outer circumferential surface 40 of the roll 22 carries a wear indicator mechanism 25. The wear surface zone 39 is shown as that portion of the roll contacting colorant between and/or beneath respective doctor blades 28–29. In the embodiment shown in FIG. 3, a wear strip 41 is provided in the outer surface of roll 22 just outside the intended image area. Wear strip 41 includes of a plurality of wear indicator cells 43*a*–*g* (see FIG. 4A). The wear indicator cells 43*a*–*g* each correlate with a depletion indicia or value 44 juxtaposed thereto. The wear indicator cells 43*a*–*g* and depletion indicia or values 44 typically are positioned just outside the image pattern (but still within the wear zone of the first doctor blade 28) though could be placed within the image pattern if acceptable. The printed or engraved depletion indicia or values 44 are generally unaffected by wear upon wear surface zone 39 of roll 22, but again, could be worn away along with its corresponding cell or cell portion.

The depletion indicia or values 44 may be provided in the form of a depletion scale, using numerals, or other indicia. The depletion indicia or values 44 (or scale) may provide the percentage of wear that has been experienced by a roll 22. Just by way of example the first wear cell to the left of "10" represents about 10 percent of the original colorant transferring via the transferring cell, and when worn off, indicates that the cells have lost about 10 percent of their depth or the like. This is only one means of detecting wear.

In other applications of the invention, it is possible to provide geometric shapes, lettering, or other visible means of indicating the amount of wear that has been experienced by the wear strip 41 of the wear indicator mechanism 25 and the roll 22. Depletion values 44, however, may not be necessary if an operator has knowledge of the amount of wear represented by each indicator cell 43*a*–*g*. The operator may simply note the number of wear indicator cells 43*a*–*g* which are absent or remaining at any given time and will thereby ascertain the degree of wear. In some embodiments, a cross-hatching or texture may be provided upon the lower surface of indicator cells, and when such texture is removed, immediately provides a visual cue to the degree of wear.

Figure 4A:
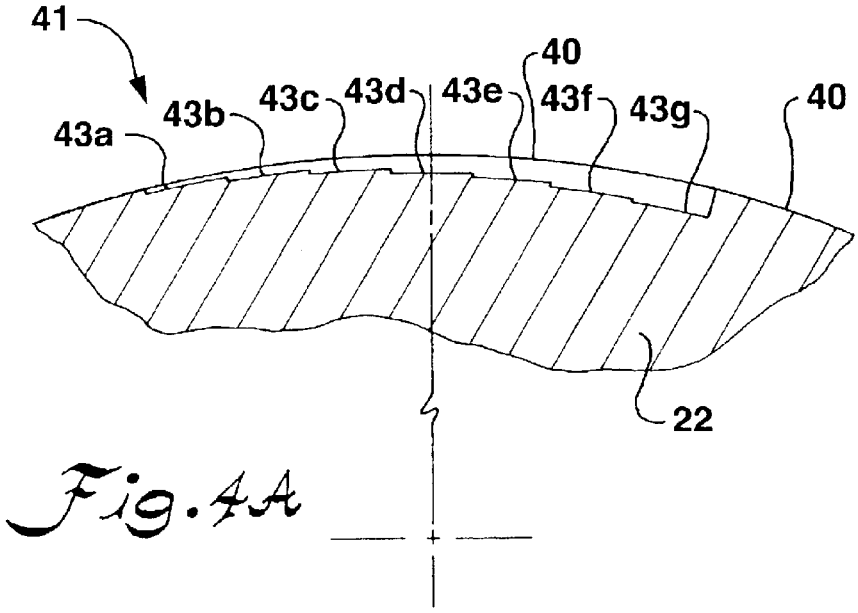
FIG. 4A shows a cross sectional view of the wear indicator mechanism having multiple indicator cells of varying predetermined depth, the cross section taken along a line 4A—4A.

In FIG. 4A, a partial cross sectional view of the wear strip 41 of the wear indicator mechanism 25 is shown. Engraved areas may be provided on the outer surface of the roll 22. In some applications, the engraved areas are cut into a hardened outer surface of the roll using a laser, such as a carbon dioxide laser. For example, wear indicator cell 43*a* may be engraved to a predetermined depth, while wear indicator cell 43*b* is engraved to an even greater depth. Successively greater depths have been engraved into the outer circumferential surface 40 of the roll as one proceeds along the outer periphery of the roll from 43*a*–43*g*. In FIG. 4A, the deepest and last wear indicator cell 43*g* is shown near the far right side of the Figure. In the application of the invention, there is no limit to the number of wear indicator cells 43*a*–*g* that may be provided. Furthermore, the wear indicator cells 43*a*–*g* could be provided within only one indicator cell, or could be spread among many such indicator cells. Etching or other suitable technique may be employed instead of engraving, to produce the wear indicator cell or cells.

Figure 4B:
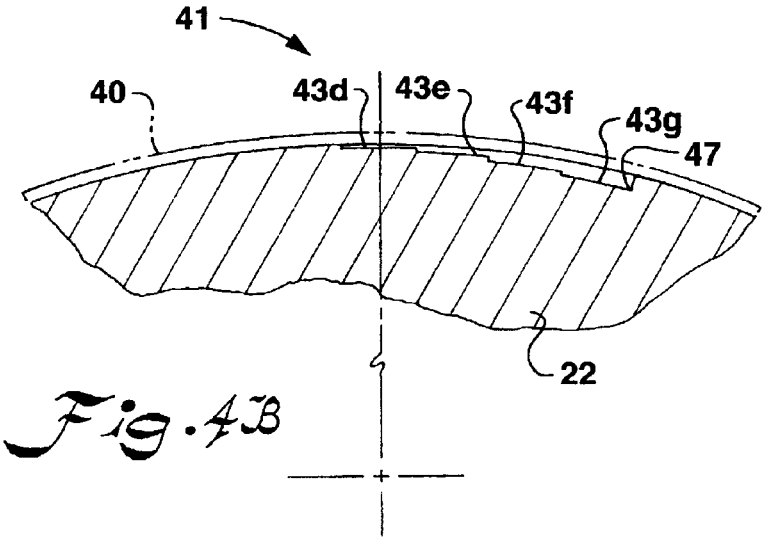
FIG. 4B shows a cross-sectional view of the embodiment shown in FIG. 4A, except that FIG. 4B illustrates a roll after it has experienced some wear and the wear indicator mechanism is indicative of that wear.

FIG. 4B shows the roll previously seen in FIG. 4A, except that the roll has experienced wear which has depleted the outer circumferential surface 40 as shown down to the depth of indicator cell 43*d*. In FIG. 4B, wear indicator cells 43*a*, 43*b*, and 43*c* are no longer visible, having been worn away during operation of roll 22. Thus, an operator observing roll 22 which is shown in FIG. 4B could readily observe that the wear indicator cell 43*d* is in alignment with a roll depletion value of about "40" (for example, as shown in FIG. 3). Or course, it would be possible to provide any number of wear indicator cells 43*a–g*, and the scale could be fine or coarse, or in any convenient units, depending upon the particular application. Furthermore, it is not always necessary to use numerical values adjacent to indicator cells 43*a–g*, because the mere absence of such indicator cells 43*a–g* may indicate to an experienced operator that a given amount of wear has occurred. That is, an operator who is aware that rolls begin with a total of seven wear indicator cells 43*a–g* (as an example) would know that by observing only five of them, that two have been worn off, indicating to him a certain value of wear by the absence of a predetermined number of such positions 43*a–g*.

Figure 4C:
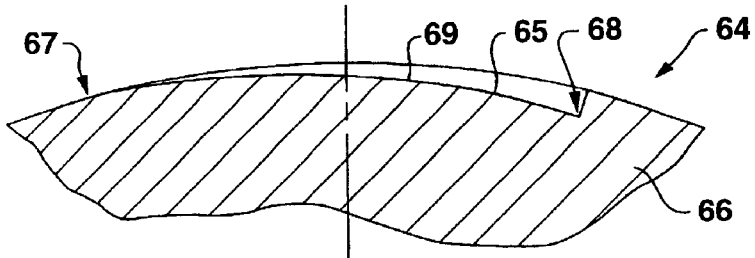
FIG. 4C illustrates another embodiment of the invention in which the depth of a single indicator cell is varied, thereby forming a sloped wall in a continuous uninterrupted line from the outer surface of the roll to a bottom point of the indicator cell.

FIG. 4C illustrates yet another embodiment of the invention in which a wear detection means 64 includes a single wear indicator cell 65. Wear indicator cell 65 is configured to have a predetermined depth. When the depth is diminished by wear, a visual indicator is provided to reveal the amount of wear of said wear indicator cell 65 upon the printing roll 66. The visual indication may be provided by the loss of a visible texture or other marking which is prepositioned upon the sloping surface 69 of the wear indicator cell 65. The sloping surface 69 extends from the outer circumferential surface 67 of the printing roll 66 to a bottom point 68 of the wear indicator cell 65. The absence of such a texture would shorten the total length of the sloping surface 69, indicating to an operator the degree of wear that has been experienced by printing roll 66.

Figure 4D:
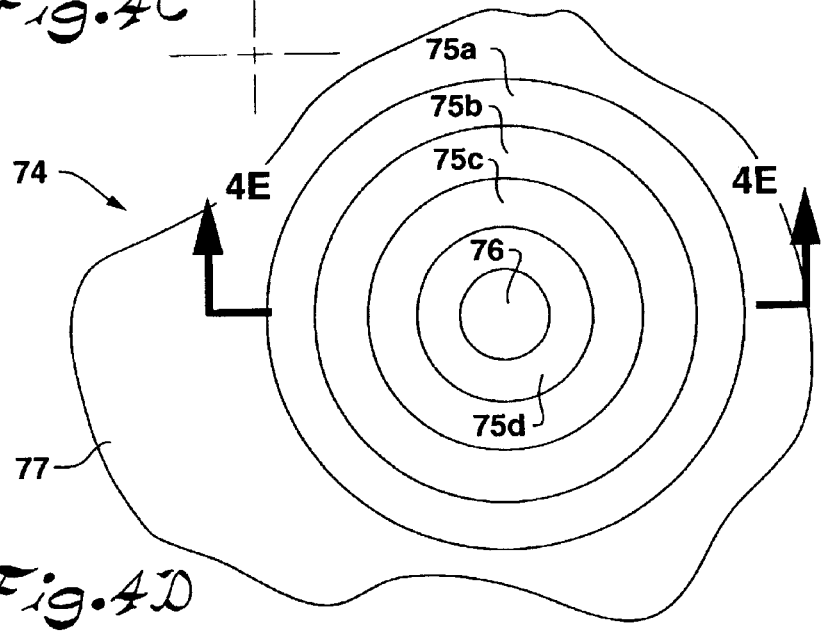
FIG. 4D illustrates a top view of a cell in yet another embodiment of the invention in which concentric rings of varying depth are provided within a single indicator cell.
Figure 4E:
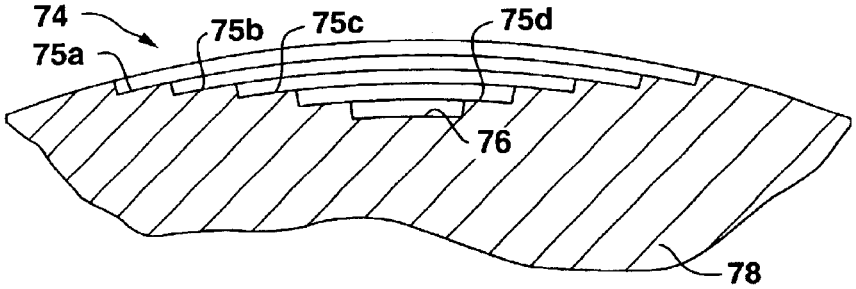
FIG. 4E illustrates a cross sectional view of the cell in FIG. 4D.

In FIG. 4D, yet another embodiment of the invention is illustrated in a top plan view, with a single indicator cell 74 providing a wear detection means by employing multiple depth portions or steps 75*a–d* in a concentric circular pattern upon the outer circumferential surface 77 of the printing roll 78. A bottom point 76 is centered, and forms the deepest portion of the indicator cell 74. A cross section of the indicator cell 74 of FIG. 4D taken along line 4E—4E is provided in FIG. 4E. Wear experienced by indicator cell 74 would deplete the printing roll 78 by first erasing depth position 75*a*, which would simply make the indicator cell 74 appear smaller in diameter. Further wear would deplete the indicator cell 75*b*, and then indicator cell 75*c*, and then indicator cell 75*d*; until only bottom point 76 would be left. Then, bottom point 76 would be depleted by additional wear. Thus, the size of the indicator cell 74 in total visible diameter would indicate the degree of wear experienced by the printing roll 78.

Figure 5:
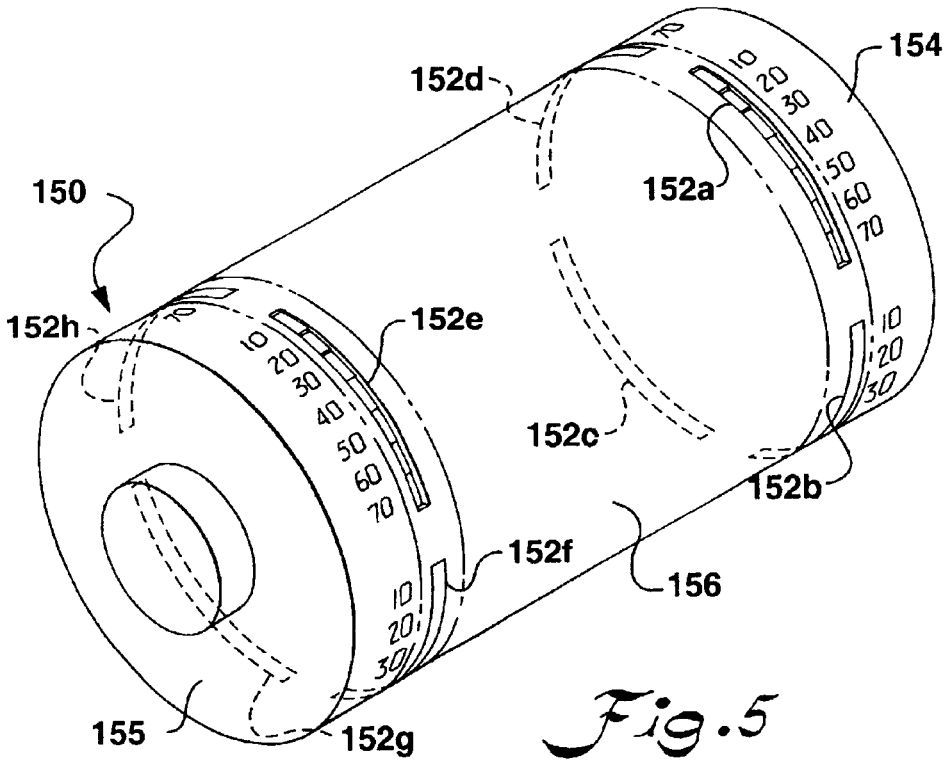
FIG. 5 is a perspective view of further embodiments of wear indications according to the present invention.

FIG. 5 illustrates further embodiments of the invention in which it is possible to provide a roll 150 with wear indicator means 152*a–h*. For example, wear indicator means 152*a–d* are located on the first end 154 of the roll 150, whereas wear indicator mechanism or means 152*e–h* are shown on the second end 155 of the roll 150. Wear experienced by the outer circumferential surface 156 of the roll 150 may be measured at various positions around the roll, at both ends of the roll, or both.

The embodiment shown in FIG. 5 provides an operator with the ability to determine if a roll is out of round, or otherwise not cylindrically oriented in correct alignment (showing uneven wear along the length of the roll). Wear indicator sets 152*a–h* could be provided in differing numbers of sets and at different locations around the circumference of the roll. For example, as shown in FIG. 5 such wear indicator sets 152*a–d* are provided at 90 degrees from each other. In other applications, such wear indicator sets 152*a–h* may be provided at differing degree intervals, e.g. when three wear indicator sets are positioned around a roll 22. Such sets 152*a–h* may be equally spaced to correlate evenness of wear around the roll.

FIG. 5 also illustrates the wear indicator sets 152*a–h* at both ends of a roll, e.g. 152*a* and 152*e*. Using such an arrangement, one can observe the two wear strips during use and ascertain the location at which wear is even along the roll.

It should be noted that FIG. 5 shows in combination two different features, that is, one feature of providing said wear indicator sets 152*a–h* on both ends of a roll, and a second feature providing said wear indicator sets in spaced groups around the circumference of a roll. One or both features may be employed independently. Some embodiments of the invention may employ both the first and second feature, as does the roll in FIG. 5.

Printing rolls include transferring cells or transferring cell structures that may be of several types, including, without limitation, trihelical, pyramidal, quadrangular, hexagonal, or hexagonal. Other shapes are possible as well. A pyramidal shaped cell may be employed in the invention. Transferring cells usually are very small, and are not illustrated in FIGS. 1–5 although it is understood that such transferring cells appear on the outer circumferential surface of such printing rolls. Rolls may be provided in many different forms in the application of the invention. The invention of this application is not limited to any particular type of roll, but may apply to numerous roll types.

Laser engraved rolls may include plasma sprayed ceramic coating (e.g. chromium oxide) that is ground and honed to a very smooth finish. A ceramic coating typically is extremely hard. Hardness is widely used as a guide to strength, wear, and erosion resistance of a coating.

Typically, lasers of any type may be used in laser engraving. For example, carbon dioxide ($CO_2$) lasers can be used to manufacture laser engraved rolls. Such lasers may be used to generate pulses of energy, whereby each pulse is responsible for producing an impression in the ceramic. Usually, to create a cell in a ceramic substrate, a laser beam must be focused upon the ceramic surface using special lenses. Commercially available lasers may be used available to persons of skill in the art. It should be understood, however, that the present invention is not limited to laser cut rolls. Any roll with cells that wear could be employed regardless of how the cells are processed. Just by way of example cells (both colorant transfer and wear indicator cells) could be either engraved, milled or the like.

Doctor blades are typically installed near the edge of the roll and are subject to significant pressure. For that reason, they typically are made of steel, such as stainless steel.

In the practice of the invention, a wear strip 41 (see FIG. 3, as example). The wear strip 41 includes a plurality of engraved positions or cells at varying depths upon the outer circumferential surface of the roll. The wear indicator cells 43*a–g* may be provided in alignment with a depletion scale, enabling correlation of positions of the depletable wear strip with depletion scale values. In this way, an indication of the amount of wear experienced by a roll is provided.

Furthermore, experienced operators may readily observe the degree of wear upon a roll simply by noting the number of wear indicator cells 43*a–g* that have been worn off during roll usage. If an operator knows the number of indicator cells 43*a–g* that are provided upon a new roll, he or she may immediately know the degree of wear without the necessity to dismount the roll and/or observe the cells of a roll under a high magnification microscope, which is a significant operational advantage.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A printing roll for applying colorant to a substrate, said printing roll having a plurality of colorant transferring cells, said roll further having an outer circumferential surface, said colorant transferring cells having a depth defined beneath said outer circumferential surface, said roll having a wear indicator mechanism about said outer surface, said wear indicator mechanism comprising at least one indicator cell having a predetermined depth relative to said depth of said colorant transferring cells, whereby wear of said indicator cell indicates the degree of wear of said colorant transferring cells, wherein said wear indicator mechanism is outside of the area defined by said colorant transferring cells.

2. The device of claim 1 wherein the outer circumferential surface of the roll comprises a ceramic coating.

3. The device of claim 2 in which said indicator cells are engraved by a laser.

4. The device of claim 1 in which a plurality of indicator cells are provided upon said printing roil, said plurality of indicator veils together comprising a first wear strip, said first wear strip being configured to visually reveal degree of wear of the colorant transferring cells.

5. The device of claim 4 wherein said roll comprises a first end and a second end, further wherein indicator cells are provided upon the outer circumferential surface of said first end and said second end of said roll.

6. The device of claim 4 wherein a plurality of wear strips are positioned around said outer circumferential surface of said roll, thereby enabling comparison between said first wear strip and said second wear strip in determining if said roll is out of round.

7. A system for determining the amount of wear experienced by a cylindrical roll, said roll being held in contact with a doctor blade, said roll being positioned to receive colorant from a reservoir and transfer the colorant to a substrate, the system comprising:

(a) a cylindrical roll, said cylindrical roll providing an outer circumferential surface having a plurality of transferring cells, said transferring cells being adapted for receiving colorant from said reservoir and transferring said colorant to a substrate;

(b) wherein said doctor blade is positioned for metering colorant from said reservoir into said transferring cells, wherein said cylindrical roll rotates while bearing against said doctor blade, and defines a wear surface, and (c) a wear indicator means, said wear indicator means being located upon the outer circumferential surface of said cylindrical roll and being outside of the area defined by said plurality of transferring cells, and being capable of indicating the degree of depletion of said wear surface.

8. The system of claim 7 in which said wear indicator means comprises at least one indicator cell.

9. The system of claim 8 wherein said at least one indicator cell is configured to have a predetermined depth, said depth being diminished as said cylindrical roll wears, further wherein a indicator is provided, correlated to said at least one indicator cell for revealing the amount of wear of said at least one indicator cell.

10. The system of claim 9 wherein said indicator cell is provided comprising a bottom well sloping from a first point to a greatest cell depth.

11. The system of claim 9 wherein one said indicator cell is provided comprising wells defining multiple depth portions.

12. The system of claim 11 wherein said multiple depth portions comprise concentrically oriented depth portions.

13. The system of claim 10 comprising further indicators along said sloping surface correlated as to the degree of wear of said cylindrical roll.

14. The system of claim 13 wherein said sloping surface comprises a texture which is depleted as the roil wears, said depletion of said texture thereby indicating visually the degree of wear of said roll.

15. The system of claim 9 wherein a plurality of indicator cells are provided, further wherein said plurality of indicator cells together comprise a wear strip, said wear strip comprising indicator cells of predetermined varying depths relative to said depth of said colorant transferring cells, whereby wear of said indicator cells indicates the degree of wear experienced by said roll, further wherein said indicator cells are provided in alignment with a depletion scale, thereby enabling correlation of positions of the wear strip with indicia upon the depletion scale in determining wear.

16. The system of claim 14 wherein said outer circumferential surface of said roll comprises a ceramic coating.

17. The system of claim 16 in which said indicator cells are engraved into said ceramic coating using a laser.

18. A method for detecting in a printing system the amount of wear experienced by a cylindrical roll, the method comprising:

(a) providing a colorant supply unit having at least one doctor blade for providing colorant for transfer in a printing process, (b) providing a cylindrical roll, said roll having an outer circumferential surface with a plurality of colorant transferring cells, the cylindrical roll being adapted for bearing against said doctor blade to receive a coating of colorant within said colorant transferring cells, (c) providing a wear indicator mechanism, outside of the area defined by said colorant transferring cells the wear indicator mechanism being configured to indicate depletion of the outer circumferential surface of the roll, (d) rotating the cylindrical roll, (e) transferring colorant from said colorant supply unit to transferring cells on said outer circumferential surface of said cylindrical roll, (f) repeating steps (d)–(e), thereby depleting the outer surface of the roll and a portion of said wear indicator mechanism, and (g) observing the amount of roil depletion from the wear indicator mechanism.

19. The method of claim 18 wherein said wear indicator mechanism comprises at least one indicator cell, wherein the intensity of said colorant employed in step (e) is adjusted in response to the amount of roll depletion observed in step (g).

20. The method of claim 18 in which said doctor blade spreads colorant into said colorant transferring cells.

21. The method of claim 19 wherein a plurality of indicator cells are provided, said plurality comprising a wear strip, said indicator cells being provided at varying depths upon the outer circumferential surface of the roll, such that wear upon said outer circumferential surface of said roll provides an indication of the amount of roll wear.

22. The method of claim 18 wherein the outer circumferential surface of the cylindrical roll comprises a ceramic coating.

23. The method of claim 21 whereby indicator coils are engraved into said ceramic coating using a laser.

24. The method of claim 23 wherein said cylindrical roll comprises a first end and a second end, wherein wear strips are provided at the first end and the second end of said roil, and observing relative wear of said wear strips to determine evenness of wear of said roll.

* * * * *

UNITED STATES PATENT AND TRADEMARK OFFICE

CERTIFICATE OF CORRECTION

PATENT NO. : 6,786,153 B2
DATED : September 7, 2004
INVENTOR(S) : William Burrow and Gregory Haley It is certified that error appears in the above-identified patent and that said Letters Patent is hereby corrected as shown below:

Column 7,
Line 33, “roil” should read -- roll --.
Line 34, “veils” should read -- cells --.

Column 8,
Lines 23 and 66, “roil” should read -- roll --.

Column 10,
Line 4, “coils” should read -- cells --.
Line 8, “roil” should read -- roll --.

Signed and Sealed this

Twenty-first Day of December, 2004

JON W. DUDAS
*Director of the United States Patent and Trademark Office*